US007553096B2

(12) United States Patent
Mindler

(10) Patent No.: US 7,553,096 B2
(45) Date of Patent: Jun. 30, 2009

(54) DETECTION OF DONOR MATERIAL USE

(75) Inventor: Robert F. Mindler, Churchville, NY (US)

(73) Assignee: Eastman Kodak Company, Rochester, NY (US)

( * ) Notice: Subject to any disclaimer, the term of this patent is extended or adjusted under 35 U.S.C. 154(b) by 311 days.

(21) Appl. No.: 11/519,418

(22) Filed: Sep. 12, 2006

(65) Prior Publication Data

US 2008/0063454 A1 Mar. 13, 2008

(51) Int. Cl.
*B41J 2/325* (2006.01)

(52) U.S. Cl. ..... 400/240; 347/171; 347/176

(58) Field of Classification Search .... 400/120–120.01, 400/120.04; 347/171, 176, 217
See application file for complete search history.

(56) References Cited

U.S. PATENT DOCUMENTS 4,704,615 A * 11/1987 Tanaka ..... 347/212
5,132,701 A * 7/1992 Stephenson et al. ..... 347/176
5,140,341 A * 8/1992 Fiscella et al. ..... 347/176
5,445,463 A 8/1995 Paranjpe et al. ..... 400/240
5,567,066 A 10/1996 Paranjpe et al. ..... 400/249
5,691,961 A 11/1997 Paranjpe et al. ..... 347/217
5,803,627 A 9/1998 Paranjpe et al. ..... 400/240
5,982,405 A * 11/1999 Sasaki et al. ..... 347/176
6,121,987 A 9/2000 Sasaki et al. ..... 347/176
2002/0191066 A1 12/2002 Bouchard et al. ..... 347/172
2006/0181597 A1 8/2006 Mindler

FOREIGN PATENT DOCUMENTS

EP 1 462 268 A 9/2004
GB 2 282 567 A 4/1995

* cited by examiner

*Primary Examiner*—Daniel J Colilla
*Assistant Examiner*—Marissa L Ferguson-Samreth
(74) *Attorney, Agent, or Firm*—Roland R. Schindler, III; David A. Novais

(57) ABSTRACT

Selectively printing full and fractional sized images with a donor ribbon. A first print order and indicia are printed while the donor ribbon is advanced through the printer. Printing is performed using donor material on a first fraction of the patch set when the print order requests a fractional sized image, or on a full patch when the print order requests a full sized image. When a second print order requests a fractional sized image, a determination is made whether the second fraction of the patch set is available for printing. An image based upon the second print order is printed using donor material from the second fraction of the patch set when it is available, or the donor ribbon is advanced to the next patch set when it is determined that the second fraction of the patch set is not available.

6 Claims, 14 Drawing Sheets

DETECTION OF DONOR MATERIAL USE

CROSS REFERENCE TO RELATED APPLICATIONS

Reference is made to commonly assigned, U.S. Pat. No. 7,286,152 issued Oct. 23,2007, entitled SYSTEM AND METHOD FOR EFFICIENT DONOR MATERIAL USE, in the names of Robert F. Mindler et al.; U.S. Pat. No. 7,400,337 issued Jul. 15,2008, entitled SYSTEM AND METHOD FOR EFFICIENT DONOR MATERIAL USE, in the name of Robert F. Mindler; and Publication No. 2007-0024693 filed Feb. 1,2007, abandoned Aug. 4,2008, entitled SYSTEM AND METHOD FOR EFFICIENT DONOR MATERIAL USE, filed in the names of Anderson et al.

FIELD OF THE INVENTION

The present invention relates to thermal printers that record images by transferring donor materials from a donor ribbon onto a receiver medium and methods for operating the same to improve the use of donor material.

BACKGROUND OF THE INVENTION

In thermal printing, as that phrase is used herein, it is generally well known to render images by selectively heating and pressing one or more donor materials such as a dye, colorant or coating against a receiver medium. The donor materials are provided in sized donor patches on a movable web known as a donor ribbon. The donor patches are organized on the donor ribbon in donor patch sets. Each donor patch set contains all of the donor patches that are to be used to record an image on the receiver medium. For full color images, a donor patch set can use multiple patches of differently colored donor material, such as yellow, magenta and cyan donor patches. Arrangements of other color patches can be used in like fashion within a donor patch set. Additionally, each donor patch set can include a clear overcoat or sealant layer.

The size of the donor patches defines the full size of an image that can be printed. Many thermal printers are capable of printing relatively large images such as 6"×8" images. While prints of this size are highly desirable for many uses, consumers often request that printers render images at a fraction of the full size image, such as images printed at the wallet size, 3"×5" size or 4"×6" size. Images at these sizes are more easily used and stored while exhausting only a fraction of the donor material from a donor patch set leaving a fraction donor patch set. Accordingly, many printers are set up to produce only these smaller, more popular standard size prints such as 4"×6" prints.

Early printers were not adapted to use the remaining donor material from a fractionally used donor patch set for printing other images. Instead, a thermal printer advances the donor ribbon to the next complete donor set after printing a fractional size image so that the thermal printer is prepared to print any size image when the next printing order is received. This results in inefficient use of the donor material and increased printing expense.

A known conventional improvement was to batch together two or more small images for printing at one time, reducing the complete print cycle time. However, if the two images were not printed together, a portion of the donor patch ribbon was not used and was wasted.

Commonly assigned U.S. patent application Ser. No. 11/060,177 entitled SYSTEM AND METHOD FOR EFFICIENT DONOR MATERIAL USE, filed Feb. 17, 2005 in the names of Robert F. Mindler et al.; Ser. No. 11/060,178 entitled SYSTEM AND METHOD FOR EFFICIENT DONOR MATERIAL USE, filed Feb. 17, 2005 in the name of Robert F. Mindler; and Ser. No. 11/192,346 entitled SYSTEM AND METHOD FOR EFFICIENT DONOR MATERIAL USE, filed Jul. 28, 2005 in the names of Anderson et al. disclose methods for individually printing images using donor material from a set of fractional donor patches. This enables more efficient use of donor material and that can do so without requiring costly changes to the printer or to the way in which the printer driver operates.

Thus, there exists a need to efficiently distinguish between complete and incomplete use of the donor patch ribbon when printing fractional size images of, say, 4"×6" when two sets of 4"×6" images are not batch together and printed at the same time.

SUMMARY OF THE INVENTION

The present invention provides a method for selectively printing full and fractional sized images with a donor ribbon having a plurality of donor patch sets. A first print order is printed while the donor ribbon is advanced through the printer. Indicia are also printed in a marginal region. The printing is performed using donor material on a first fraction of the donor patch set when the print order requests a fractional sized image, or on a full donor patch when the print order requests a full sized image. When a second print order is received, the donor ribbon is advanced to a next donor patch set if the print order requests a full sized image. If the second print order requests a fractional sized image, a determination is made whether the second print order can be printed on a second fraction of the donor patch set. The determination is made by rewinding the donor ribbon a distance far enough to detect the presence of or the absence of the indicia at a position indicative of whether the second fraction of the donor patch set is available for printing. An image based upon the second print order is printed using donor material from the second fraction of the donor patch set when it is determined that the second fraction of the donor patch set is available, or the donor ribbon is advanced to the next donor patch set when it is determined that the second fraction of the donor patch set is not available.

DETAILED DESCRIPTION OF THE INVENTION

Figure 1:
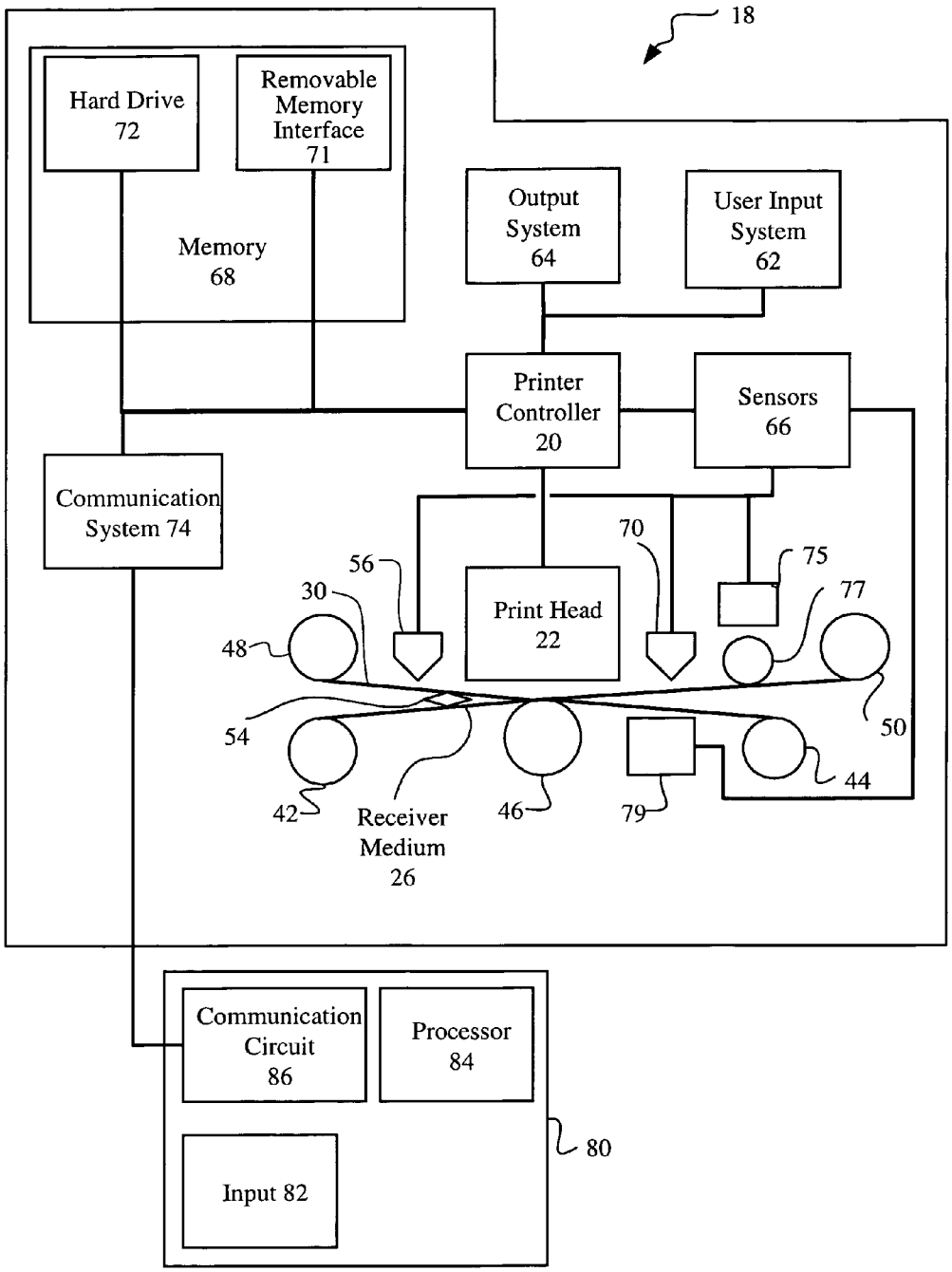
FIG. 1 shows a printer driver and printer according to the present invention.

FIGS. 1-4 show a first embodiment of a printing system of the invention. As is shown in FIG. 1, a printer 18 includes a controller 20 adapted to cause a printhead 22 to record images on a receiver medium 26 by transferring material from a donor ribbon 30 to receiver medium 26. Controller 20 can include but is not limited to a programmable digital computer, a programmable microprocessor, a programmable logic controller, a series of electronic circuits or a series of electronic circuits reduced to the form of an integrated circuit, or a series of discrete components. Controller 20 also controls a receiver medium take-up roller 42, a receiver medium supply roller 44, a donor ribbon take-up roller 48 and a donor ribbon supply roller 50, which are each motorized for rotation on command of the controller 20 to effect movement of receiver medium 26 and donor ribbon 30.

Figure 2:
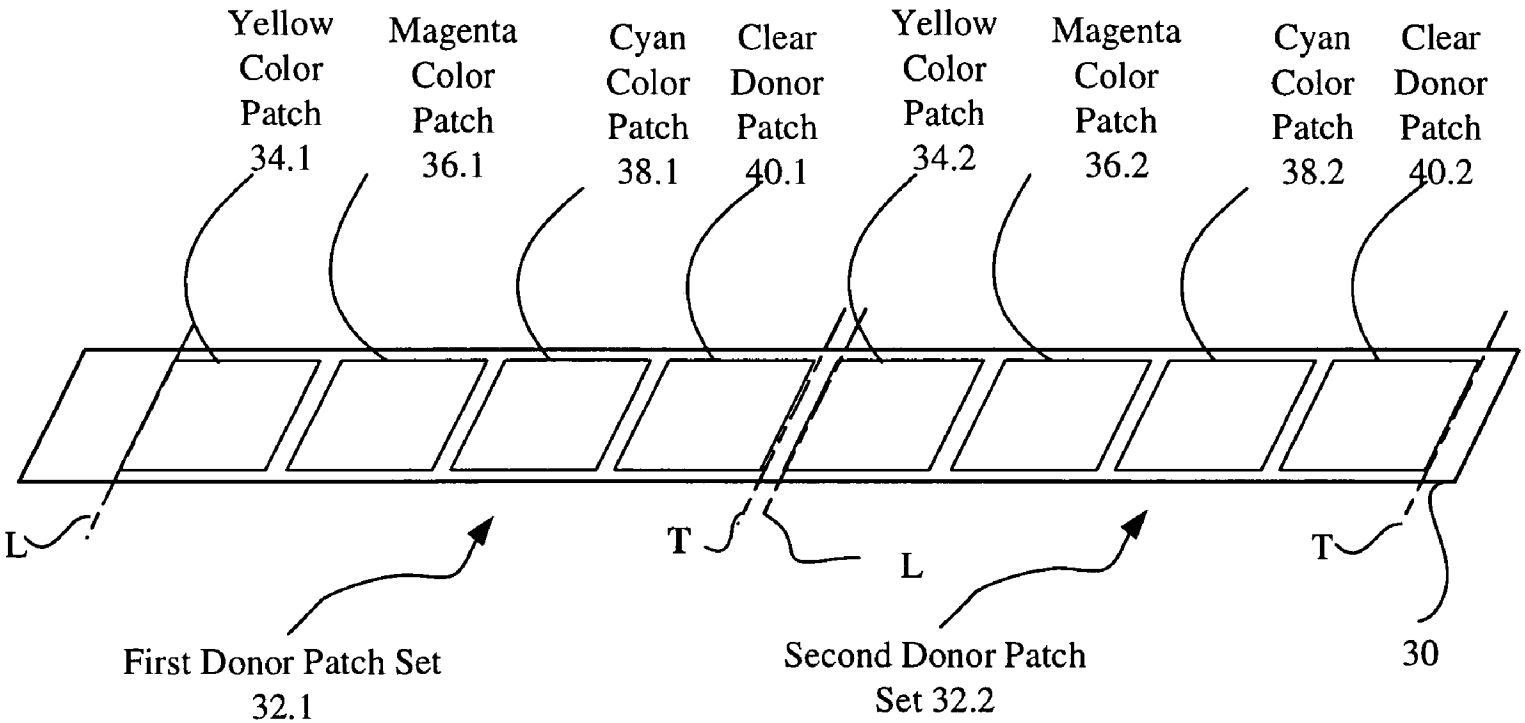
FIG. 2 shows a donor ribbon according to the present invention.

Referring to FIG. 2, donor ribbon 30 comprises a set 32.1 of donor patches having a yellow donor patch 34.1, a magenta donor patch 36.1, a cyan donor patch 38.1 and a clear overcoat patch 40.1. A second donor patch set 32.2 follows, having a yellow donor patch 34.2, a magenta donor patch 36.2, a cyan donor patch 38.2 and a clear overcoat patch 40.2. Each set of donor patches has a leading edge (L) and a trailing edge (T). In order to provide a full color image with a clear protective coating, the four patches of each set of donor patches are printed, in registration with each other, onto a common image receiving area 52 of receiver medium 26 shown in FIG. 3.

Figure 3:
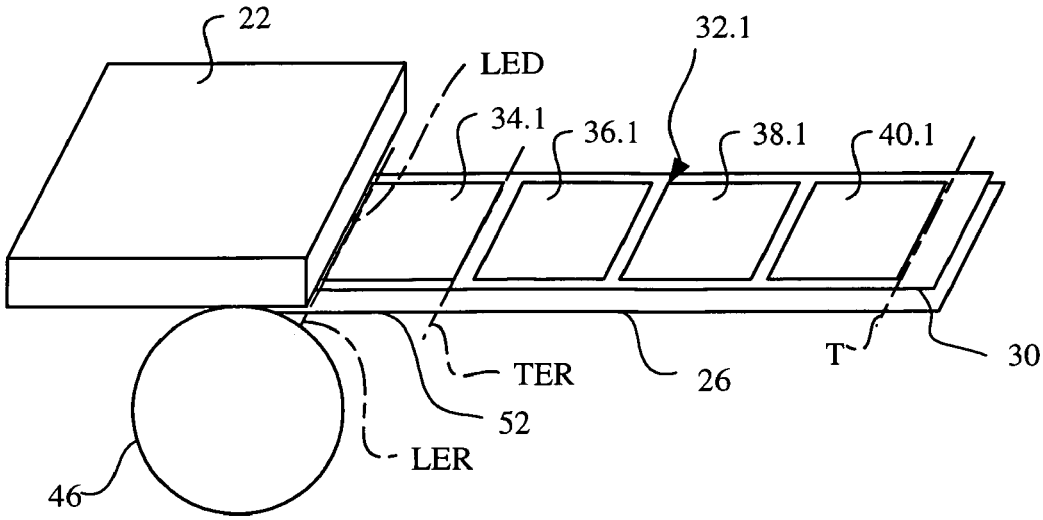
FIG. 3 shows a printhead, donor ribbon and receiver ribbon at a start of a first printing process for a first donor patch.

A first color is printed by moving donor ribbon 30 in the conventional direction, from right to left with respect to printhead 22 as seen in FIGS. 1 and 3. During printing, controller 20 raises printhead 22 and actuates donor ribbon supply roller 50 and donor ribbon take-up roller 48 to advance a leading edge L of set 32 of donor patches to printhead 22. Leading edge L of set 32.1 of donor patches is defined by at a leading edge of yellow donor patch 34.1. The position of leading edge L can be determined by using a donor position sensor 70 to detect a marking, indicia on donor ribbon 30 that has a known position relative to the leading edge of yellow donor patch 34.1 or by directly detecting leading edge of yellow donor patch 34.1 as will be discussed in greater detail below.

Controller 20 also actuates receiver medium take up roller 42 and receiver medium supply roller 44 so that image receiving area 52 of receiver medium 26 is positioned with respect to printhead 22. An image receiving area 52 is defined by a leading edge LER and a trailing edge TER on receiver medium 26. When donor ribbon 30 and receiver medium 26 are positioned so that leading edge LED of yellow donor patch 34.1 is registered at printhead 22 with leading edge LER of image receiving area 52. Controller 20 then lowers printhead 22 so that a lower surface of donor ribbon 30 engages receiver medium 26, which is supported by platen roller 46.

Figure 4:
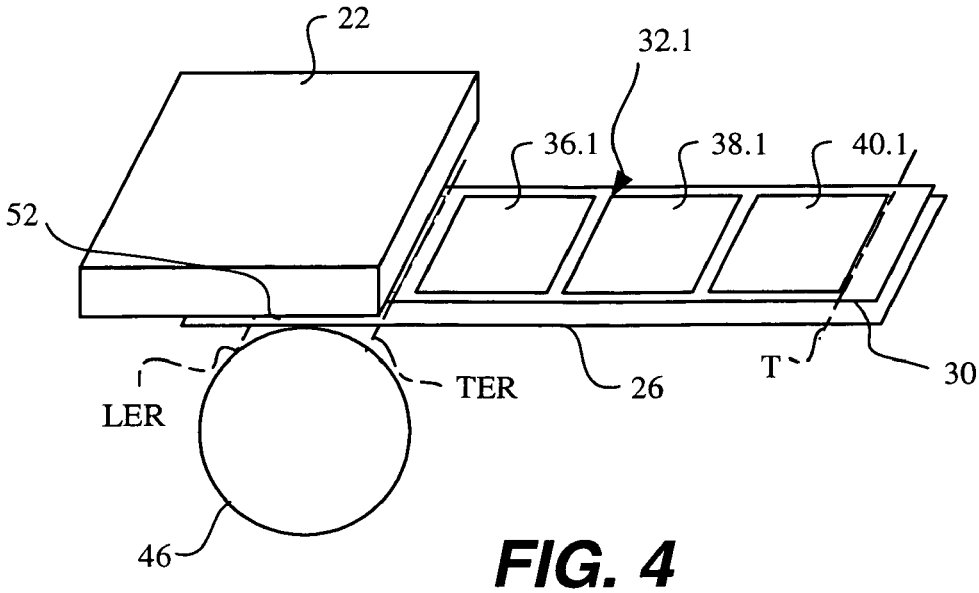
FIG. 4 shows a printhead, donor ribbon and receiver ribbon at a conclusion of a first printing process for a first donor patch.

Controller 20 then actuates receiver medium take-up roller 42, receiver medium supply roller 44, donor ribbon take-up roller 48 and donor ribbon supply roller 50 to move receiver medium 26 and donor ribbon 30 together past printhead 22. Controller 20 selectively operates heater elements (not shown) in printhead 22 to transfer donor material from yellow donor patch 34.1 to receiver medium 26. As donor ribbon 30 and receiver medium 26 leave the printhead 22, a stripping plate 54 separates donor ribbon 30 from receiver medium 26. Donor ribbon 30 continues past a donor patch color-sensing device 56 toward the donor ribbon take-up roller 48. As shown in FIG. 4, after printing the trailing edge TER of image receiving area 52 of receiver medium 26 remains on platen roller 46. Controller 20 then adjusts the position of donor ribbon 30 and receiver medium 26 using a predefined pattern of donor ribbon movement so that a leading edge of each of the remaining donor patches 36, 38 and 40 are brought into alignment with leading edge LER of image receiving area 52 and the printing process is repeated to transfer further material as desired to complete the image.

Controller 20 operates the printer 18 based upon input signals from a user input system 62, sensors 66, a memory 68 and a communication system 74. User input system 62 can comprise any form of transducer or other device capable of receiving an input from a user and converting this input into a form that can be used by controller 20. For example, user input system 62 can comprise a touch screen input, a touch pad input, a 4-way switch, a 6-way switch, an 8-way switch, a stylus system, a trackball system, a joystick system, a voice recognition system, a gesture recognition system or other such systems. An output system 64, such as a display, is optionally provided and can be used by controller 20 to provide human perceptible signals for feedback, informational or other purposes.

Sensors 66 can include light sensors and other sensors known in the art that can be used to detect conditions in the environment-surrounding printer 18 and to convert this information into a form that can be used by controller 20 in governing printing operation. Referring to FIG. 1, sensors 66 include a donor position sensor 70 that is adapted to detect the position of donor ribbon 30 and a receiver medium position sensor 79. Controller 20 cooperates with donor position sensor 70 to monitor donor ribbon 30 during movement thereof so that controller 20 can detect one or more conditions on donor ribbon 30 that indicate a leading edge of a donor patch set. In this regard, donor ribbon 30 can be provided that has markings or other optically, magnetically or electronically sensible indicia between each donor patch set. Where such markings or indicia are provided, donor position sensor 70 senses these markings or indicia and provides signals to controller 20. Controller 20 can use these markings and indicia to determine when donor ribbon 30 is positioned with the leading edge L of a donor patch set or when any of the edges of any of the donor patches is at printhead 22. In a similar way, controller 20 can use signals from receiver medium position sensor 79 to monitor the position of receiver medium 26 to align receiver medium 26 during printing.

During a full image printing operation, controller 20 causes donor ribbon 30 to be advanced in a predetermined pattern of distances so as to cause a leading edge of each of the first donor patches 34.1, 36.1, 38.1 and 40.1 to be properly positioned relative to the image receiving area 52 at the start of each printing process. Controller 20 can be adapted to achieve such positioning by precise control of the movement of donor ribbon 30 using a stepper type motor for motorizing donor ribbon take up roller 48 or donor ribbon supply roller 50 or by using a movement sensor 75 that can detect movement of donor ribbon 30. In one example an arrangement using a movement sensor 75, a follower wheel 77 is provided that engages donor ribbon 30 and moves therewith. Follower wheel 77 can have surface features that are optically, magnetically or electronically sensed by movement sensor 75. One example of this is a follower wheel 77 that has markings thereon indicative of an extent of movement of donor ribbon 30 and a movement sensor 75 that has a light sensor that can sense light reflected by the markings. In other embodiments, perforations, cutouts or other routine and detectable indicia can be incorporated onto donor ribbon 30 in a manner that enables a movement sensor 75 to provide an indication of the extent of movement of the donor ribbon 30.

Alternatively, donor position sensor 70 can be adapted to sense the color of donor patches on donor ribbon 30 and can provide color signals to controller 20. In this alternative, controller 20 is programmed or otherwise adapted to detect a color that is known to be found in the first donor patch, e.g. yellow donor patch 34.1 in a set of donor patches. When the first color is detected, controller 20 can determine that donor ribbon 30 is positioned proximate to the start of a donor patch set.

Data including, but not limited to, control programs, digital images and metadata can also be stored in memory 68. Memory 68 can take many forms and can include, without limitation, conventional memory devices including solid state, magnetic, optical or other data storage devices. Memory 68 is shown having a removable memory interface 71 for communicating with removable memory (not shown) such as a magnetic, optical or magnetic disks. Memory 68 is also shown having an optional hard drive 72 that is fixed with printer 18.

Controller 20 has a communication system 74 for communicating external devices such as remote memory 76. Communication system 74 can be, for example, an optical, radio frequency circuit or transducer that converts electronic signals representing an image and other data into a form that can be conveyed to a separate device by way of an optical signal, radio frequency signal or other form of signal.

A printer driving device 80 is illustrated in FIG. 1. Printer driving device 80 has an input 82 adapted to receive a print order requesting the printing of at least one image. Input 82 can comprise a manual user input for manually receiving a user input action and determining a print order at least in part based upon the user input action. Input 82 can also comprise a receiver for receiving a request from a remote source such as a telecommunication network, computer network or remote device such as a cellular telephone. For example, input 82 can include, but is not limited to, circuits and systems known to those of skill in the art for receiving entries made by way of user input action, or in response to a data provided by way of a memory (not shown) including, but not limited to, data provided by way of a removable memory (not shown).

When a print order is received from input 82, processor 84 analyzes the print order and forms a set of page data streams based upon the print order. Each page data stream comprises data representing one image from the print order in a format that can be used by printer 20 to cause one image from the print order to be printed. In this regard, processor 84 can be provided with printer driver software or custom application programming for use in forming the page data streams. Each page data stream is transmitted to printer 20. In the embodiment illustrated, the page data stream is transmitted by a signal sent by communication circuit 86 to communication system 74 of printer 18. A communication circuit 86 can also be used to receive print orders from remote sources and in that sense can also comprise input 82.

Controller 20 is operable to cause printing of differently sized images. In a full image mode, controller 20 prints images having image sizes that will exhaust most of the donor material in the donor patches of a donor patch set. In one example of this type, some images will be sized so that a single image will consume most of the donor material from an entire donor patch set. Likewise other combinations of images such as a request for a set of multiple wallet-sized prints will likewise consume substantially all of the donor material available in a single donor patch set. Controller 20 is also adapted to print images having various sizes that exhaust only a fraction of the donor material provided by a donor patch set and that leave a fractional donor set having donor patches with unused donor material that can be used to form what is referred to herein as a fractional size image.

Thus, there exists a need to efficiently distinguish between complete and incomplete use of a color patch of the donor ribbon when printing fractional size images of, say, 4"×6" when two sets of 4"×6" images are not batch together and printed at the same time. That is, there is a need to efficiently determine if there is a fractional donor set available having donor patches with unused donor material that can be used to form a fractional size image.

Figure 5:
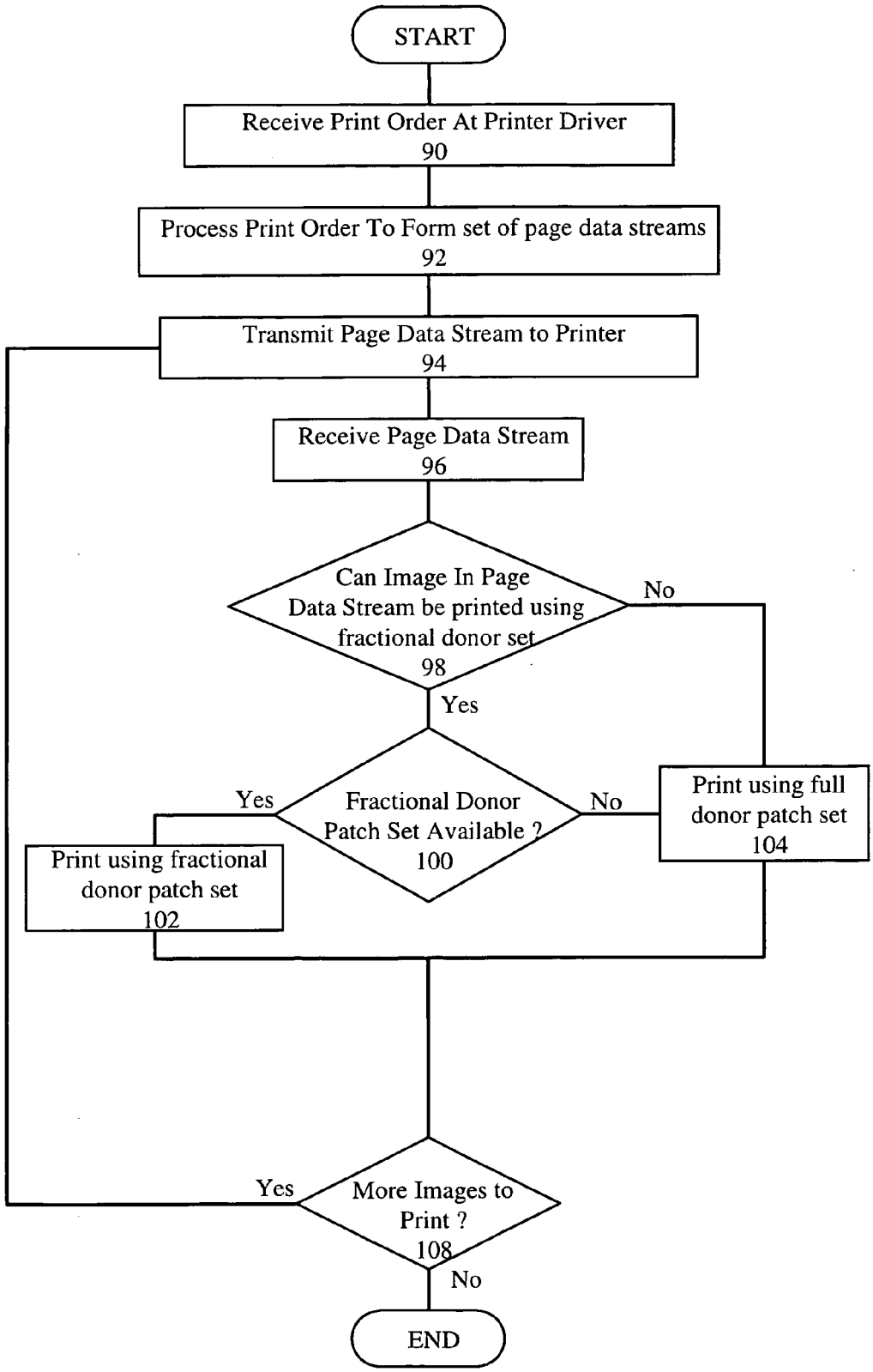
FIG. 5 is a logic diagram of a method for operating a printer in accordance with the present invention.

FIG. 5 is a flow diagram showing a method for operating printer 18 in accordance with the invention. Printer driving device 80 receives a print order (step 90) and processes the print order (step 92) to form a set of page data streams. Each page data stream comprises image data representing one image from the print order. The page data stream may include metadata from which it can be determined whether the received page data stream can be printed using a fractional donor patch set. Each page data stream is then transmitted (step 94) by communication circuit 82 and is received (step 96) by communication system 74 of printer 18.

Printer controller 20 receives each page data stream from communication system 74 and determines whether the image requested can be printed using a fractional donor patch set (step 98). One way to determine whether the image from a page data stream can be printed using a fractional donor patch is to analyze the image data and to make the determination based at least in part upon the amount of image information to be printed. This determination can also be made using other forms of image analysis. Where the page data stream includes metadata from which it can be determined whether the image can be printed using a fractional donor patch set, such metadata can be used to make this determination. Examples of such metadata include, but are not limited to, image size metadata, or image format metadata.

If a fractional donor set cannot be used (a "No" response at step 98), a print is made using a full donor set (step 104), and the process continues. If, however, it is determined that fractional donor set can be printed using a fractional donor patch and that a fractional donor patch is available, printer controller 20 will cause donor ribbon 30 to be positioned so that remaining portions of a fractional donor patch set are used in rendering the image (step 102). Where printer controller 20 determines that the image from a page data stream cannot be printed using a fractional donor patch set, or where printer controller 20 determines that a fractional donor patch set is not available, printer controller 20 can cause a subsequent full donor patch set i.e., second donor patch set 32.2 to be used for printing the image (step 104).

During a printing pass, donor ribbon 30 moves to the left (as viewed in FIG. 6A) past print head 22 of FIG. 1. A Dmax bar 110 is printed following the image area 112 in a marginal region of the over-all print area of cyan donor patch 38.1. Such marginal regions are typically provided to allow for borderless prints and are cut off of the final print delivered to the customer. The printing of Dmax bar 110 depletes the donor patch in the marginal region, and creates a readable mark or pattern in the donor ribbon referred to hereinafter as an indicia. This indicia can be detected by color-sensing device 54 (FIG. 1) after a printing pass as the donor ribbon is rewound back toward the lead edge of the yellow donor patch 34.1. A suitable tri-color-sensing device is used in the KODAK Photo Printer 6800. A first of three sensors emits a HIGH output in the presence of red light. A second of the three sensors emits a HIGH output in the presence of green light. A third of the three sensors emits a HIGH output in the presence of blue light. Therefore, the first (red) sensor has a HIGH signal when reading yellow donor patch 34.1, a HIGH signal when reading magenta donor patch 36.1, and a LOW signal when reading cyan donor patch 38.1. This is illustrated in FIG. 6B. The second (green) sensor has a HIGH signal when reading yellow donor patch 34.1, a LOW signal when reading magenta donor patch 36.1, and a HIGH signal when reading cyan donor patch 38.1. This is illustrated in FIG. 6C. The third (blue) sensor has a LOW signal when reading yellow donor patch 34.1, a HIGH signal when reading magenta donor patch 36.1, and a HIGH signal when reading cyan donor patch 38.1. This is illustrated in FIG. 6D. Of course all of the sensor outputs are HIGH when they are reading clear overcoat patch 40.1, the clear regions between donor patches, and Dmax bar 92.

Figure 6A:
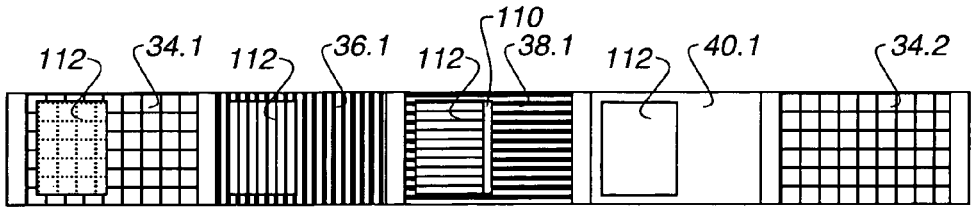
FIG. 6A shows a donor ribbon after being used to print a first fractional size image.
Figure 6B:
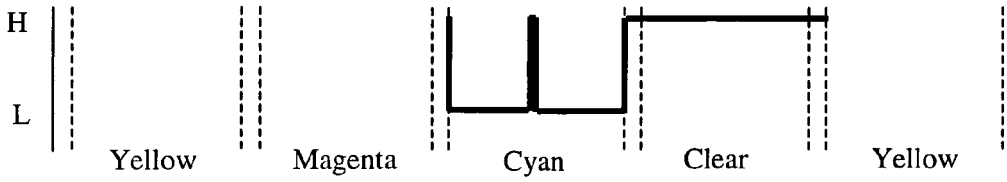
FIGS. 6B-6D illustrate the output signals of a donor patch color-sensing device reading the donor ribbon of FIG. 6A.
Figure 6C:
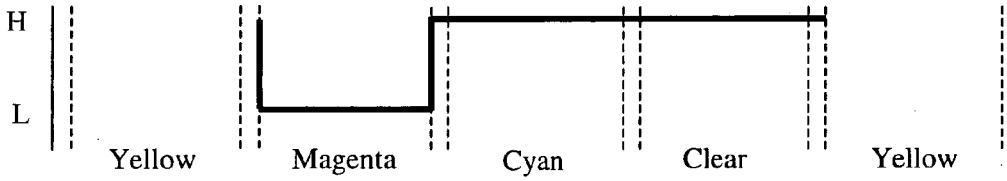
Figure 6D:
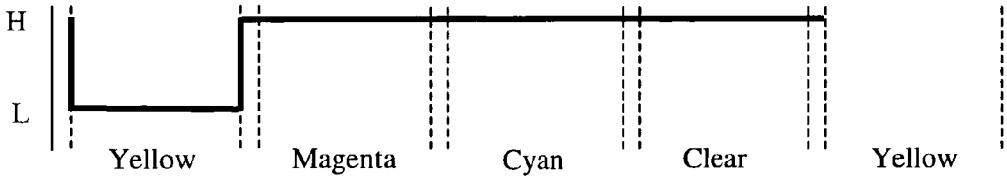
Figure 7A:
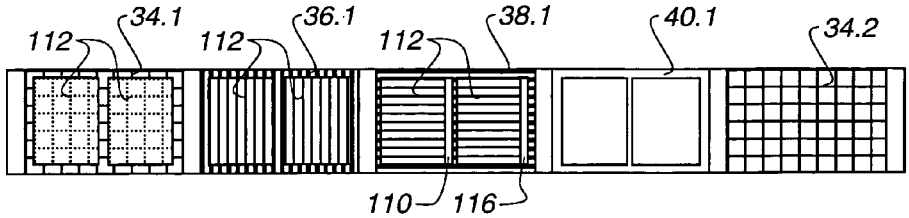
FIG. 7A shows a donor ribbon after being used to print two fractional size images.
Figure 7B:
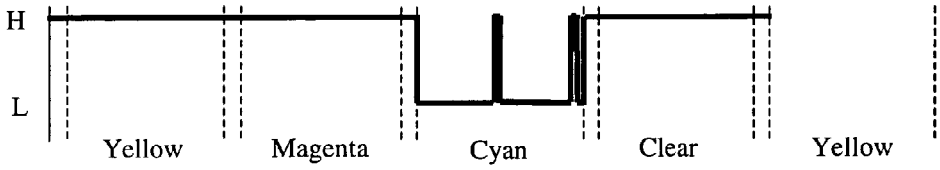
FIGS. 7B-7D illustrate the output signals of a donor patch color-sensing device reading the donor ribbon of FIG. 7A.
Figure 7C:
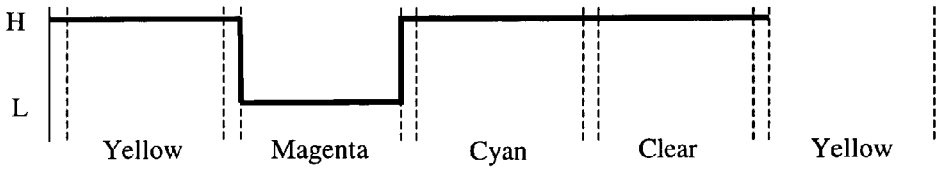
Figure 7D:
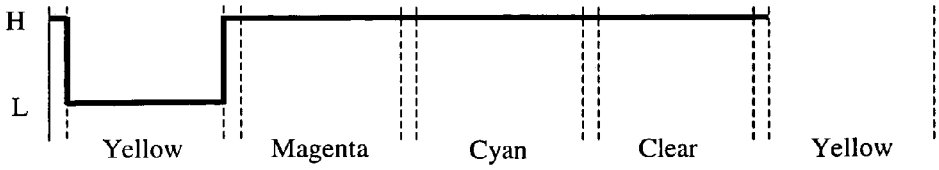
Figure 8A:
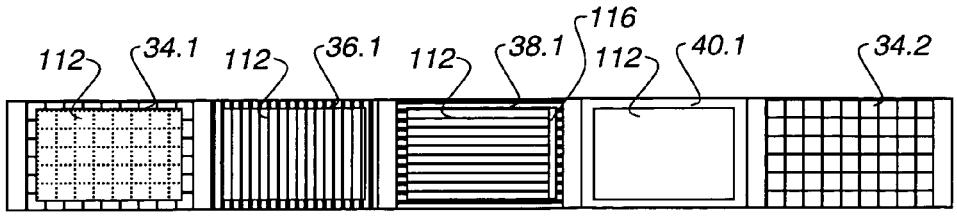
FIG. 8A shows a donor ribbon after being used to print a non-fractional size image.
Figure 8B:
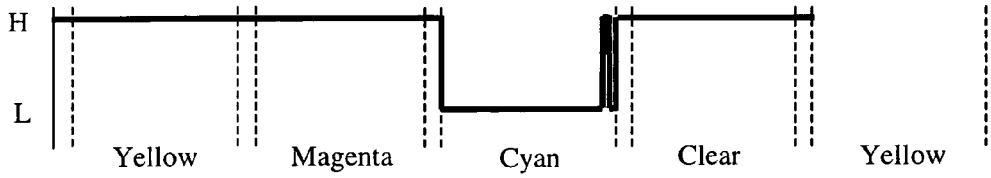
FIGS. 8B-8D illustrate the output signals of a donor patch color-sensing device reading the donor ribbon of FIG. 6A.
Figure 8C:
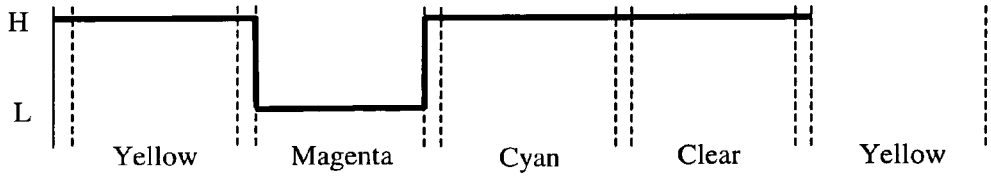
Figure 8D:
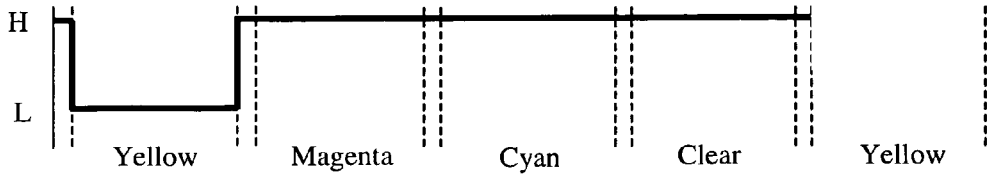
Figure 9:
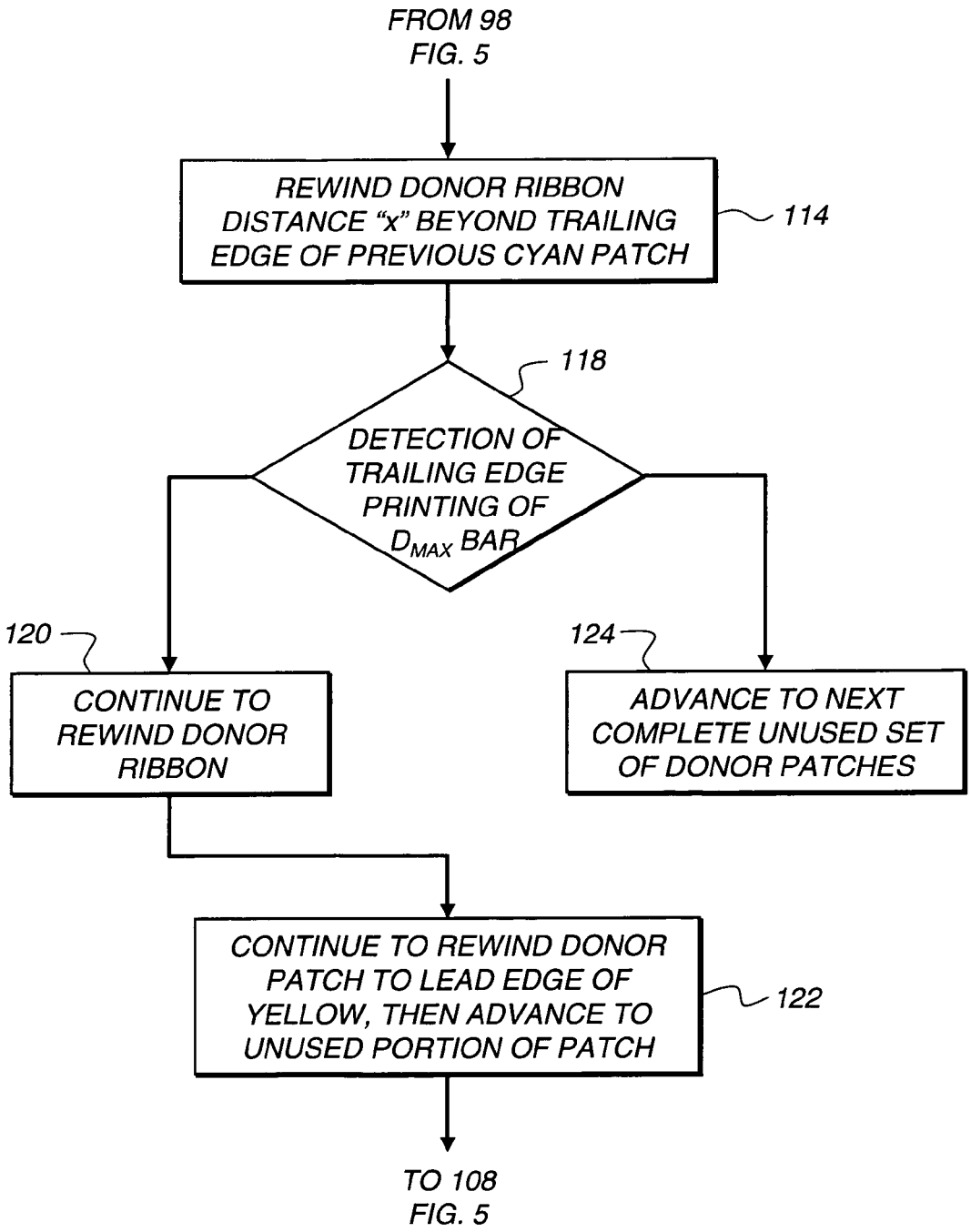
FIG. 9 is a detailed logic diagram of Step 100 of FIG. 5.

If a fractional size image has been printed during the first pass, each of the first donor patches 34.1, 36.1, 38.1 and 40.1 will have been partially depleted in image areas 112 as shown in FIG. 6A. If two fractional size images have been printed on first donor patches 34.1, 36.1, 38.1 and 40.1, the entirety of first donor patches 34.1, 36.1, 38.1 and 40.1 will have been depleted in image areas 112 as shown in FIG. 7A. If a full image has been printed using a full donor patch set, the entirety of first donor patches 34.1, 36.1, 38.1 and 40.1 will have been depleted in image areas 112 as shown in FIG. 8A.

If the decision at step 98 of FIG. 5 is that the next image in the page data stream can be printed using a fractional donor set, printer controller 20 must then determine if a fractional donor patch set is available for printing (step 100). The process will be explained with occasional reference to FIGS. 6A-9.

After the first pass through the printer's print head, donor ribbon 30 is rewound at least to a position that is a predetermined distance "x" beyond the trailing edge of cyan patch 38.1 (step 114). Distance "x" is far enough for sensor 56 to detect the existence of a depleted Dmax bar 116 just beyond the trailing edge of cyan patch 38.1 as shown in FIGS. 7A and 8A, but not so far as to detect the existence of the first depleted Dmax bar 110. In other words, distance "x" extends into the right hand fractional donor patch and not into the left hand fractional donor patch.

If donor patch color-sensing device 54 does not detect a depleted Dmax bar 116 by the time that it has reached distance "x" beyond the trailing edge of cyan patch 38.1 (step 118), it is apparent that a fractional size image has been printed during the first pass and further that a second fractional donor patch set is available for printing. Once this has been determined, the ribbon can be totally rewound to the leading (left) edge of yellow patch 34.1 (steps 120) and advanced, such as be stepper motor, until the print head is just past the first printed image area's Dmax bar 110 and is aligned with the beginning of the unused portion of yellow donor patch for printing (step 122). Printing of a second of two fractional size images can now proceed on first donor patches 34.1, 36.1, 38.1 and 40.1. The printer is now set to move to the second donor patches 34.2, 36.2, 38.2 and 40.2 for printing the next image.

If donor patch color-sensing device 54 does detect a depleted Dmax bar 116 before it has reached distance "x" beyond the trailing edge of cyan patch 38.1 as would happen in the examples illustrated in FIG. 7A and FIG. 8A, it is apparent that a the entire donor patch set was used during the preceding pass and that no fractional donor patch set is available for printing. Once this has been determined, the donor ribbon is advanced to the next full set of donor patches 34.2, 36.2, 38.2 and 40.2 for printing the next image (step 124).

In the embodiment of the invention illustrated in FIGS. 6A-8D, once this has been determined, the ribbon is totally rewound to the leading (left) edge of yellow patch 34.1 and advanced, such as by a stepper motor, until the print head is just past the first printed image area's Dmax bar and is aligned with the beginning of the unused portion of yellow donor patch for printing. Although this has proven to work well, there is a potential that the stepper motor may not be sufficiently accurate to register the beginning of the second fractional size images. This can result in overprinting of a portion of the first fractional size images or of running out of donor patch before the second fractional size images are complete. Accordingly, a second embodiment of the present invention is illustrated in FIGS. 10A-12D.

Figure 10A:
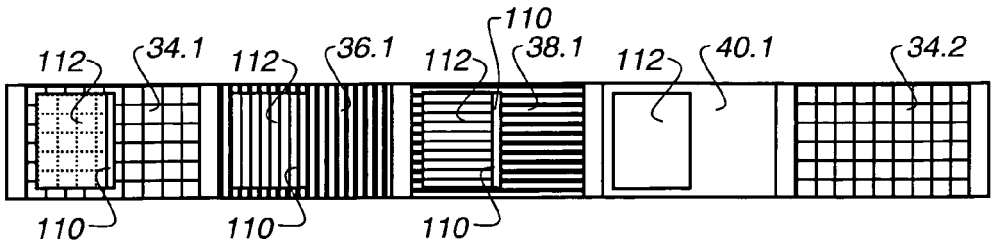
FIG. 10A shows a donor ribbon after being used to print a first fractional size image according to a second embodiment of the present invention.
Figure 10B:
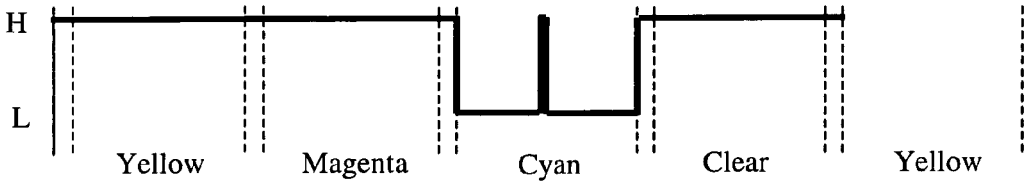
FIGS. 10B-10D illustrate the output signals of a donor patch color-sensing device reading the donor ribbon of FIG. 10A.
Figure 10C:
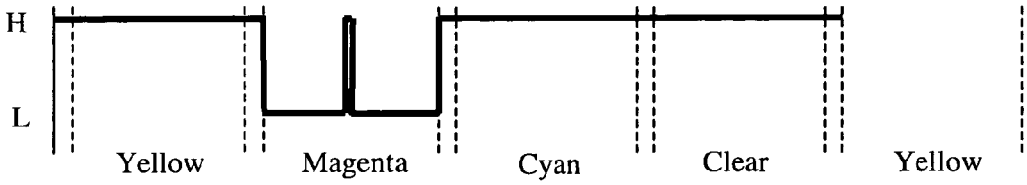
Figure 10D:
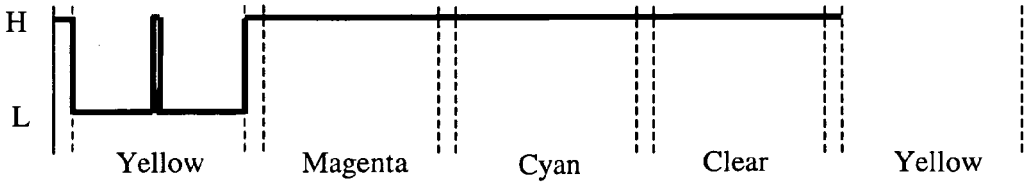
Figure 11A:
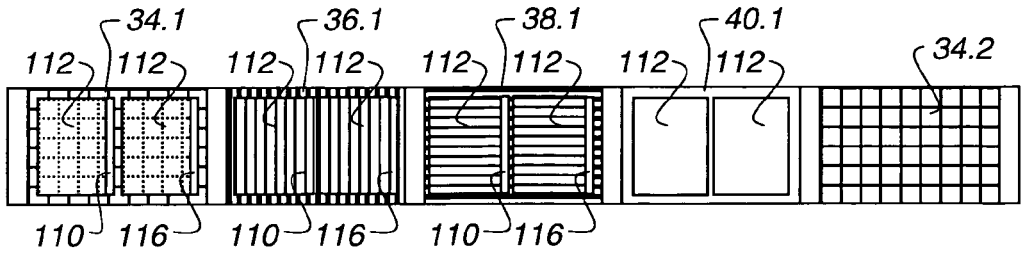
FIG. 11A shows the donor ribbon of FIG. 10A after being used to print a two fractional size images.
Figure 11B:
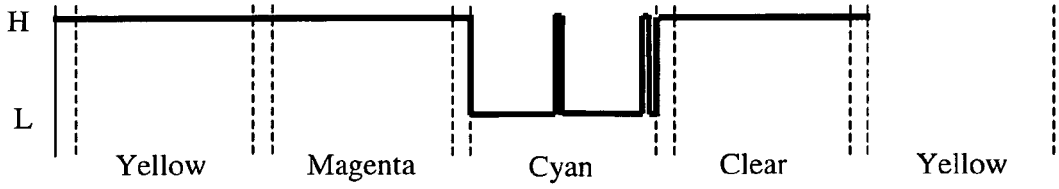
FIGS. 11B-11D illustrate the output signals of a donor patch color-sensing device reading the donor ribbon of FIG. 11A.
Figure 11C:
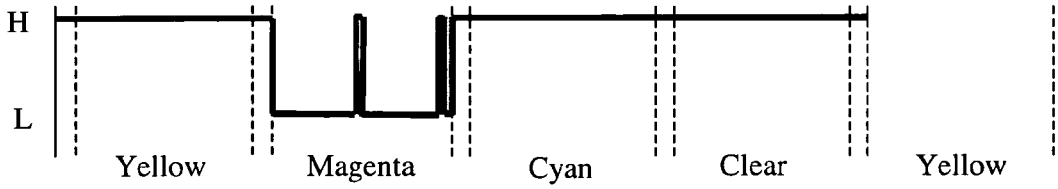
Figure 11D:
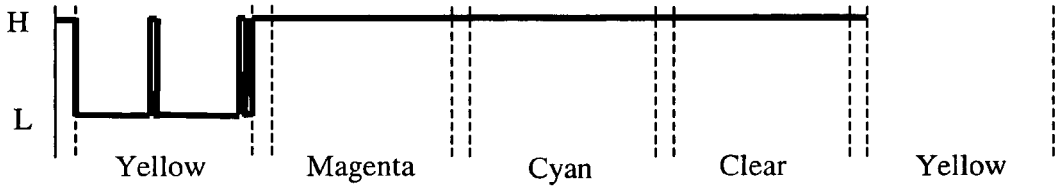

Referring to FIG. 10A, it can be seen that a Dmax bar 110 is printed following the image area 112 of all of the used donor patches 34.1, 36.1, 38.1 and 40.1. If a fractional size image has been printed during the first pass, each of the first donor patches 34.1, 36.1, 38.1 and 40.1 will have been partially depleted in image areas 112 as shown in FIG. 10A. If two fractional size images have been printed on first donor patches 34.1, 36.1, 38.1 and 40.1, the entirety of first donor patches 34.1, 36.1, 38.1 and 40.1 will have been depleted in image areas 112 as shown in FIG. 11A. If a full image has been printed using a full donor patch set, the entirety of first donor patches 34.1, 36.1, 38.1 and 40.1 will have been depleted in image areas 112 as shown in FIG. 12A.

Decision at step 98 of this, second embodiment is the same as that of the first embodiment. That is, after the first pass through the printer's print head, donor ribbon 30 is rewound at least to a position that is a predetermined distance "x" beyond the trailing edge of cyan patch 38.1 (step 114). Distance "x" is far enough for sensor 56 to detect the existence of a depleted Dmax bar 116 just beyond the trailing edge of cyan patch 38.1, but not so far as to detect the existence of the first depleted Dmax bar 110.

If donor patch color-sensing device 54 does not detect a depleted Dmax bar 116 by the time that it has reached distance "x" beyond the trailing edge of cyan patch 38.1 (step 118), it is apparent that a fractional size image has been printed during the first pass and further that a second fractional donor patch set is available for printing. Once this has been determined, the ribbon can be totally rewound to the leading (left) edge of yellow patch 34.1 (steps 120) and advanced until, the print head is just beyond the Dmax bar of the first image of the yellow donor patch. This accurately aligns the print head with the beginning of the unused portion of yellow donor patch without reliance on the accuracy of a stepper motor to measure the distance from the leading edge of the yellow donor patch. Printing of a second of two fractional size images can now proceed on first donor patches 34.1, 36.1, 38.1 and 40.1. The printer is now set to move to the second donor patches 34.2, 36.2, 38.2 and 40.2 for printing the next image.

Figure 12A:
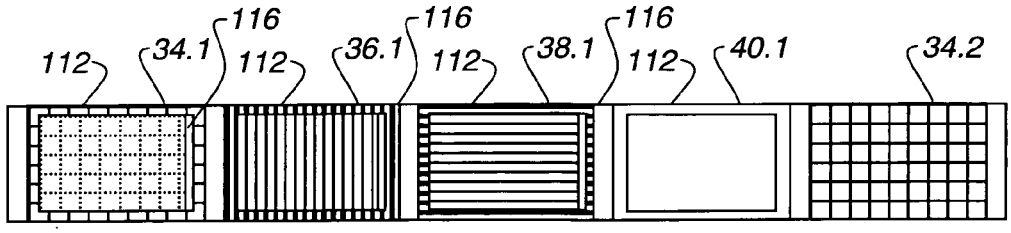
FIG. 12A shows a donor ribbon after being used to print a non-fractional size image.
Figure 12B:
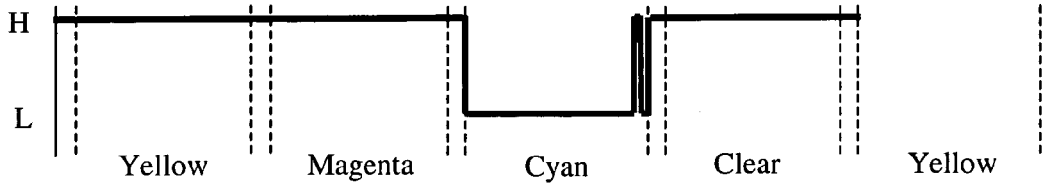
FIGS. 12B-12D illustrate the output signals of a donor patch color-sensing device reading the donor ribbon of FIG. 12A.
Figure 12C:
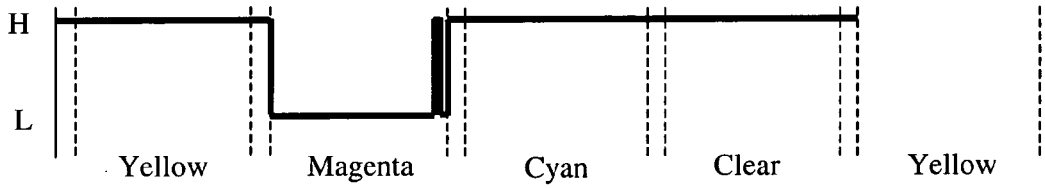
Figure 12D:
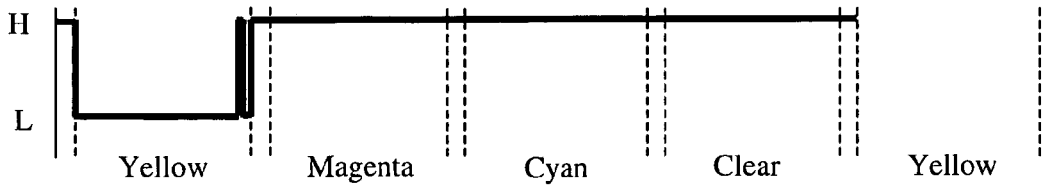

If donor patch color-sensing device 54 does detect a depleted Dmax bar 116 before it has reached distance "x" beyond the trailing edge of cyan patch 38.1 as would happen in the examples illustrated in FIG. 11A and FIG. 12A, it is apparent that a the entire donor patch set was used during the preceding pass and that no fractional donor patch set is available for printing. Once this has been determined, the donor ribbon is advanced to the next full set of donor patches 34.2, 36.2, 38.2 and 40.2 for printing the next image.

Should the power be turned off to the printer while the print head is align with clear overcoat patch, and if the position of the ribbon is not stored in non-volatile memory, there is a potential that the system will not be able to return the ribbon to a position where it can print the second of two fractional size images on first donor patches 34.1, 36.1, 38.1 and 40.1. In that case, the ribbon would have to be advanced to the next totally unused set of donor patches, wasting the unused fractional donor patches. The third embodiment of the present invention, illustrated in FIGS. 13A-15D overcomes this problem.

Figure 13A:
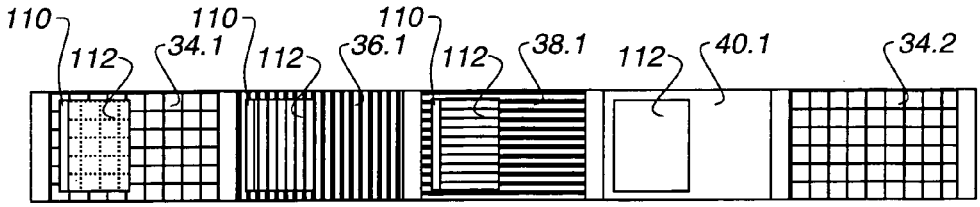
FIG. 13A shows a donor ribbon after being used to print a first fractional size image according to a third embodiment of the present invention.
Figure 13B:
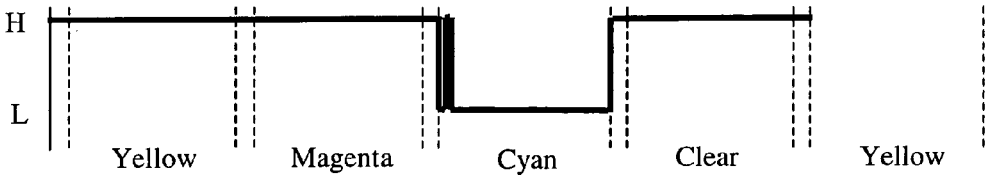
FIGS. 13B-13D illustrate the output signals of a donor patch color-sensing device reading the donor ribbon of FIG. 13A.
Figure 13C:
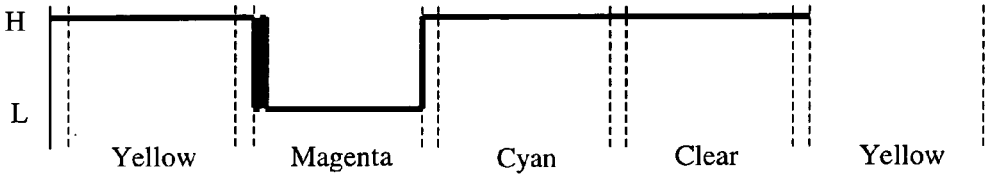
Figure 13D:
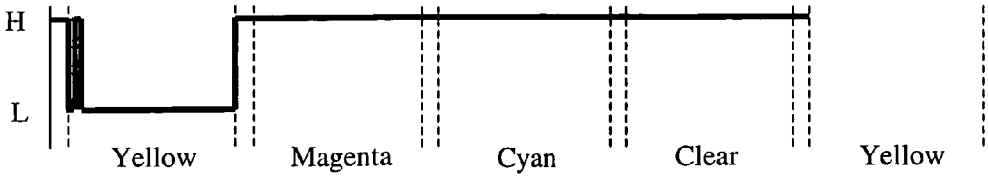
Figure 14A:
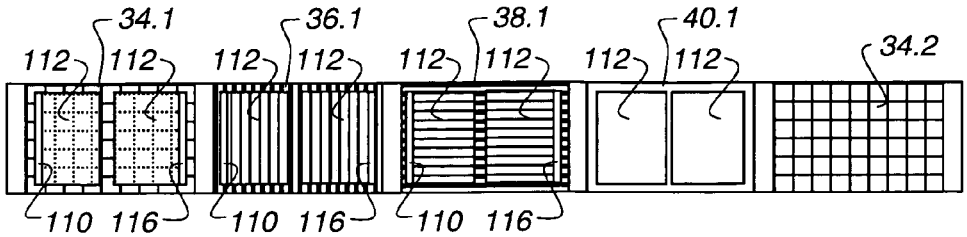
FIG. 14A shows the donor ribbon of FIG. 13A after being used to print a two fractional size images.
Figure 14B:
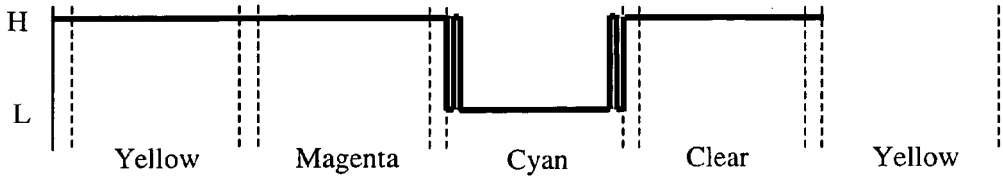
FIGS. 14B-14D illustrate the output signals of a donor patch color-sensing device reading the donor ribbon of FIG. 14A.
Figure 14C:
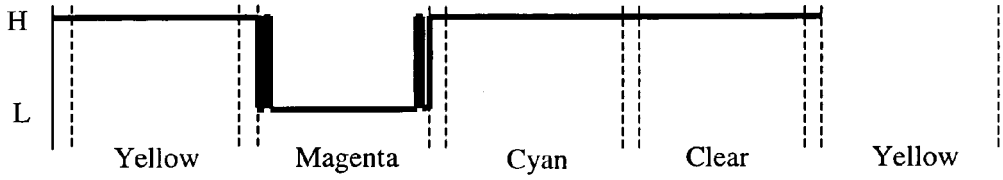
Figure 14D:
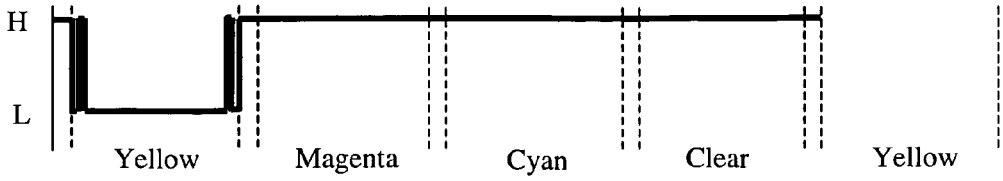

Referring to FIG. 13A, it can be seen that a Dmax bar 110 is printed before the image area 112 of all of the used donor patches 34.1, 36.1, 38.1 and 40.1. If a fractional size image has been printed during the first pass, each of the first donor patches 34.1, 36.1, 38.1 and 40.1 will have been partially depleted in image areas 112 as shown in FIG. 13A. If two fractional size images have been printed on first donor patches 34.1, 36.1, 38.1 and 40.1, the entirety of first donor patches 34.1, 36.1, 38.1 and 40.1 will have been depleted in image areas 112 as shown in FIG. 14A. If a full image has been printed using a full donor patch set, the entirety of first donor patches 34.1, 36.1, 38.1 and 40.1 will have been depleted in image areas 112 as shown in FIG. 15A.

Decision at step 98 of this, second embodiment is the same as that of the first and second embodiments. That is, after the first pass through the printer's print head, donor ribbon 30 is rewound at least to a position that is a predetermined distance "x" beyond the trailing edge of cyan patch 38.1 (step 114). Distance "x" is far enough for sensor 56 to detect the existence of a depleted Dmax bar 116 just beyond the trailing edge of cyan patch 38.1, but not so far as to detect the existence of the first depleted Dmax bar 110.

If donor patch color-sensing device 54 does not detect a depleted Dmax bar 110 by the time that it has reached distance "x" beyond the trailing edge of cyan patch 38.1 (step 118), it is apparent that a fractional size image has been printed during the first pass and further that a second fractional donor patch set is available for printing. Once this has been determined, the ribbon can be totally rewound to the leading (left) edge of yellow patch 34.1 (steps 120) and advanced until, the print head is an entire fractional donor patch beyond the Dmax bar of the first image of the yellow donor patch. This accurately aligns the print head with the beginning of the unused portion of yellow donor patch without reliance on the accuracy of a stepper motor to measure the distance from the leading edge of the yellow donor patch. Printing of a second of two fractional size images can now proceed on first donor patches 34.1, 36.1, 38.1 and 40.1. The printer is now set to move to the second donor patches 34.2, 36.2, 38.2 and 40.2 for printing the next image.

Figure 15A:
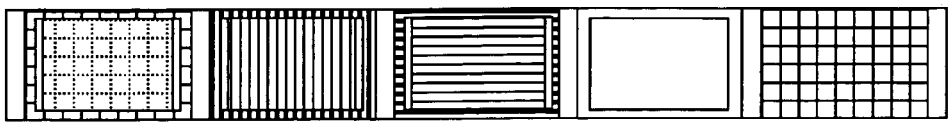
FIG. 15A shows the donor ribbon of FIG. 13A after being used to print a non-fractional size image.
Figure 15B:
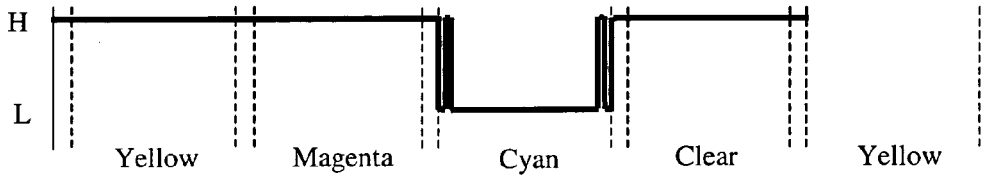
FIGS. 15B-15D illustrate the output signals of a donor patch color-sensing device reading the donor ribbon of FIG. 15A.
Figure 15C:
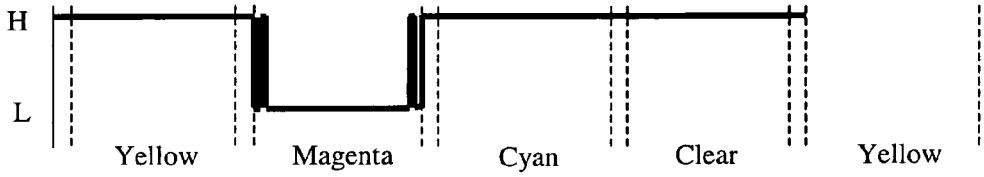
Figure 15D:
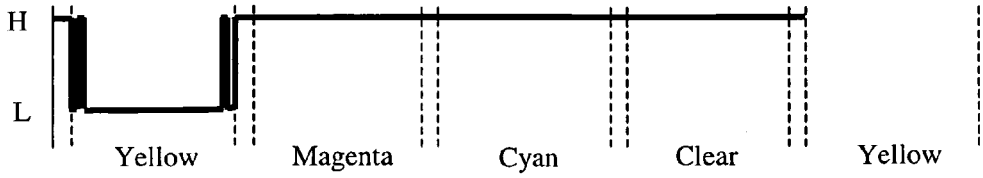

If donor patch color-sensing device 54 does detect a depleted Dmax bar 116 before it has reached distance "x" beyond the trailing edge of cyan patch 38.1 as would happen in the examples illustrated in FIG. 14A and FIG. 15A, it is apparent that a the entire donor patch set was used during the preceding pass and that no fractional donor patch set is available for printing. Once this has been determined, the donor ribbon is advanced to the next full set of donor patches 34.2, 36.2, 38.2 and 40.2 for printing the next image.

Should power be restored to a printer that was turned off while the print head was aligned with clear overcoat patch 40.1, the donor ribbon begins to rewind. If donor patch color-sensing device 54 does not detect a depleted Dmax bar 116 by the time that it has reached distance "x" beyond the trailing edge of cyan patch 38.1 (step 118), it is apparent that a fractional size image has been printed during the first pass and further that a second fractional donor patch set is available for printing. Once this has been determined, the ribbon can be totally rewound to the leading (left) edge of yellow patch 34.1 (steps 120) and advanced until, the print head is an entire fractional donor patch beyond the Dmax bar of the first image of the yellow donor patch. This accurately aligns the print head with the beginning of the unused portion of yellow donor patch without reliance on the accuracy of a stepper motor to measure the distance from the leading edge of the yellow donor patch. Printing of a second of two fractional size images can now proceed on first donor patches 34.1, 36.1, 38.1 and 40.1. The printer is now set to move to the second donor patches 34.2, 36.2, 38.2 and 40.2 for printing the next image. If donor patch color-sensing device 54 does detect a depleted Dmax bar 92 before it has reached distance "x" beyond the trailing edge of cyan patch 38.1 as would happen in the examples illustrated in FIG. 14A and FIG. 15A, it is apparent that a the entire donor patch set was used during the preceding pass and that no fractional donor patch set is available for printing. Once this has been determined, the donor ribbon is advanced to the next full set of donor patches 34.2, 36.2, 38.2 and 40.2 for printing the next image.

The invention has been described in detail with particular reference to certain preferred embodiments thereof, but it will be understood that variations and modifications can be effected within the spirit and scope of the invention.

PARTS LIST

16 printing system
18 printer
20 printer controller
22 printhead

26 receiver medium
30 donor ribbon
32.1 first donor patch set
32.2 second donor patch set
34.1 yellow donor patch
34.2 yellow donor patch
36.1 magenta donor patch
36.2 magenta donor patch
38.1 cyan donor patch
38.2 cyan donor patch
40.1 clear overcoat patch
40.2 clear overcoat patch
42 receiver medium take-up roller
44 receiver medium supply roller
46 platen roller
48 donor ribbon take-up roller
50 donor ribbon supply roller
52 image receiving area
54 donor patch color-sensing device
56 idler roller
62 user input system
64 output system
66 sensors
68 memory
70 donor position sensor
71 removable memory interface
72 hard drive
74 communication system
75 movement sensor
76 remote memory
77 follower wheel
79 receiver medium position sensor
80 printer driving device
82 input
84 processor
86 communication circuit
88 network
90 receive print order step
92 process print order step
94 transmit page data stream step
96 receive page data stream step
98 image printed using fractional donor set determining step
100 fractional donor set available determining step
102 print using fractional donor patch set step
104 print using full donor patch set step
108 more images for printing determining step
110 Dmax bar
112 image area
114 rewind step
116 Dmax bar
118 determining step
120 rewind step
122 continue rewind step
124 advance step

The invention claimed is:

1. A method for selectively printing full and fractional sized images with a donor ribbon having a plurality of donor patch sets, each donor patch set having at least one patch of length sufficient to print both a full sized image and an indicia in a marginal region; said method comprising the steps of:

receiving a first print order at a thermal printer having a printhead, said first print order requesting the printing of an image of one of said full and fractional sizes;

advancing the donor ribbon through the thermal printer in a print direction;

printing an image based upon the print order plus an indicia in the marginal region, wherein said printing is performed using donor material on:

(1) a first fraction of the donor patch set when the print order requests a fractional sized image, and (2) a full donor patch when the print order requests a full sized image;

receiving a second print order at the printer;

advancing the donor ribbon to a next donor patch set if the print order requests a full sized image;

determining if the second print order can be printed on a second fraction of the donor patch set if the print order requests a fractional sized image, wherein at the completion of the first print order the donor ribbon is moved to a position aligning the second fraction of the donor patch set with the printhead in the event that at least part of the second print order can be satisfied using donor material from the second fraction of the donor patch set, said determining step comprising rewinding the donor ribbon in a direction opposite to the print direction a distance far enough to detect the presence of or the absence of the indicia at a position indicative of whether said second fraction of the donor patch set is available for printing; and printing an image based upon the second print order using donor material from the second fraction of the donor patch set when it is determined that said second fraction of the donor patch set is available, or advancing the donor ribbon to the next donor patch set when it is determined that said second fraction of the donor patch set is not available.

2. A method as set forth in claim 1 wherein the indicia is a Dmax bar.

3. A method as set forth in claim 1 wherein the indicia is printed in a marginal region of the donor patch following the image.

4. A method as set forth in claim 1 wherein the indicia is printed in a marginal region of the donor patch preceding a first image printed on a donor patch.

5. A method as set forth in claim 4 wherein the indicia is printed in a marginal region of the donor patch following a second image printed on a donor patch.

6. A method as set forth in claim 4 wherein the position of the indicia that is indicative of whether a fractional donor patch set is available for printing coincides with said second fraction of the donor patch set.

* * * * *